US008267142B2

(12) United States Patent
Ferri et al.

(10) Patent No.: US 8,267,142 B2
(45) Date of Patent: Sep. 18, 2012

(54) MODULAR LABELING STATION

(75) Inventors: Marco Ferri, Mantova (IT); Mattia Giuliani, Mantova (IT)

(73) Assignee: Sidel Holdings & Technology S.A., Pully (CH)

( * ) Notice: Subject to any disclaimer, the term of this patent is extended or adjusted under 35 U.S.C. 154(b) by 538 days.

(21) Appl. No.: 12/480,825

(22) Filed: Jun. 9, 2009

(65) Prior Publication Data

US 2009/0301662 A1 Dec. 10, 2009

(30) Foreign Application Priority Data

Jun. 10, 2008 (EP) ..... 08157910

(51) Int. Cl.
*B65C 9/00* (2006.01)

(52) U.S. Cl. ..... 156/567; 156/538; 156/556; 156/566

(58) Field of Classification Search ..... None
See application file for complete search history.

(56) References Cited

U.S. PATENT DOCUMENTS

| | | | | |
|---|---|---|---|---|
| 7,883,656 | B2 * | 2/2011 | Calvert | 264/272.19 |
| 2005/0153427 | A1 * | 7/2005 | Eder et al. | 435/287.1 |

FOREIGN PATENT DOCUMENTS

| | | |
|---|---|---|
| DE | 20221208 | 6/2005 |
| DE | 10 2004 054057 | 8/2005 |
| DE | 29724903 | 10/2005 |
| EP | 1449809 | 8/2004 |
| EP | 1493671 | 1/2005 |
| EP | 1553045 | 7/2005 |
| EP | 1820735 | 8/2007 |
| EP | 1820736 | 8/2007 |
| EP | 1939095 | 7/2008 |

* cited by examiner

*Primary Examiner* — Mark A Osele
*Assistant Examiner* — Nickolas Harm
(74) *Attorney, Agent, or Firm* — Shoemaker and Mattare

(57) ABSTRACT

Modular labeling station suitable for being detachably connectable to a labeling machine in a labeling arrangement. The labeling station comprises a base suitable to lay on a floor at a side distal from the labeling machine and to lay substantially on the labeling machine at a side proximal to the labeling machine itself, and a labeling unit mounted on the base in an adjustable manner. The base lays on the labeling machine at a portion that is structurally independent from the labeling unit.

14 Claims, 6 Drawing Sheets

MODULAR LABELING STATION

FIELD OF THE INVENTION

This application relates to a modular labeling station for example of a beverage bottling plant for handling bottles or other containers.

BACKGROUND OF THE INVENTION

According to a possible embodiment, the modular labeling station may be one station of a beverage bottling plant for filling bottles with a liquid beverage filling material. In this case the plant may comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. There may also be provided a conveyer arrangement that is designed to move bottles, for example, from an inspecting machine to the filling machine.

In case of a beverage bottling plant, after a filling process has been completed, the filled beverage bottles are transported or conveyed to a closing machine, which is often a rotary closing machine. There may further be provided a conveyer arrangement configured to transfer filled bottles from the filling machine to the closing station.

The closing machine closes bottles by applying a closure, such as a screw-top cap or a bottle cork, to a corresponding bottle mouth. Closed bottles are then usually conveyed to labeling station for example by means of a corresponding conveyer arrangement. Bottles are then sorted and packaged for shipment out of the plant.

Beverage bottling plants may also comprise a rinsing arrangement or rinsing station. Downstream of the rinsing arrangement or rinsing station, in the direction of travel, rinsed bottles are then transported to the beverage filling machine.

A known modular labeling station is known in the form of a rotating labeling machine from German Patent No. 202 21 208 UI, in which a plurality of labeling units are arranged in a free-standing manner, i.e., standing with their own feet on a base, on the periphery of a rotor driven to rotate about a vertical machine axis. In order to attain the necessary alignment of the free-standing labeling units with reference to the machine frame for the proper application of the equipment elements or labels onto the bottles or containers, additional elements are provided on the periphery of the machine frame for establishing the position of the respective labeling unit relative to the machine frame.

A modular labeling station may be exchanged with no problem and without expending a great deal of time, in order to convert the machine from one container type or size to another container type or size, and/or from one equipment feature to another equipment feature, in particular also to perform calibration or adjustment tasks and/or repairs on the labeling station separately from the machine, and thus without interrupting production. However, one disadvantage of the known machine is comprised in that because of the free-standing arrangement of the labeling station on the periphery of the machine frame, height adjustment or alignment, inter alia, is required for each unit.

Another modular labeling station is known from EP-A-1820736 in which it comprises a centering and docking unit suitable to be detachably connected to a centering and docking unit of the stationary frame portion of the machine in order to support the labeling station in a load-transferring manner.

Still another modular labeling station is known from EP-B1-1493671 in which the labeling station is completely lifted from the floor when attached to the stationary frame of the machine.

An object of at least one possible embodiment of the present application is to provide modular labeling station retaining the advantage of detachable labeling station, to make it interchangeable, when needed, and permitting simplified docking and levelling of the stations to the machine.

BRIEF DESCRIPTION OF THE DRAWINGS

At least one possible embodiment of the present application is explained in greater detail below illustrated in the accompanying drawings, in which.

DETAILED DESCRIPTION OF THE INVENTION

Figure 8:
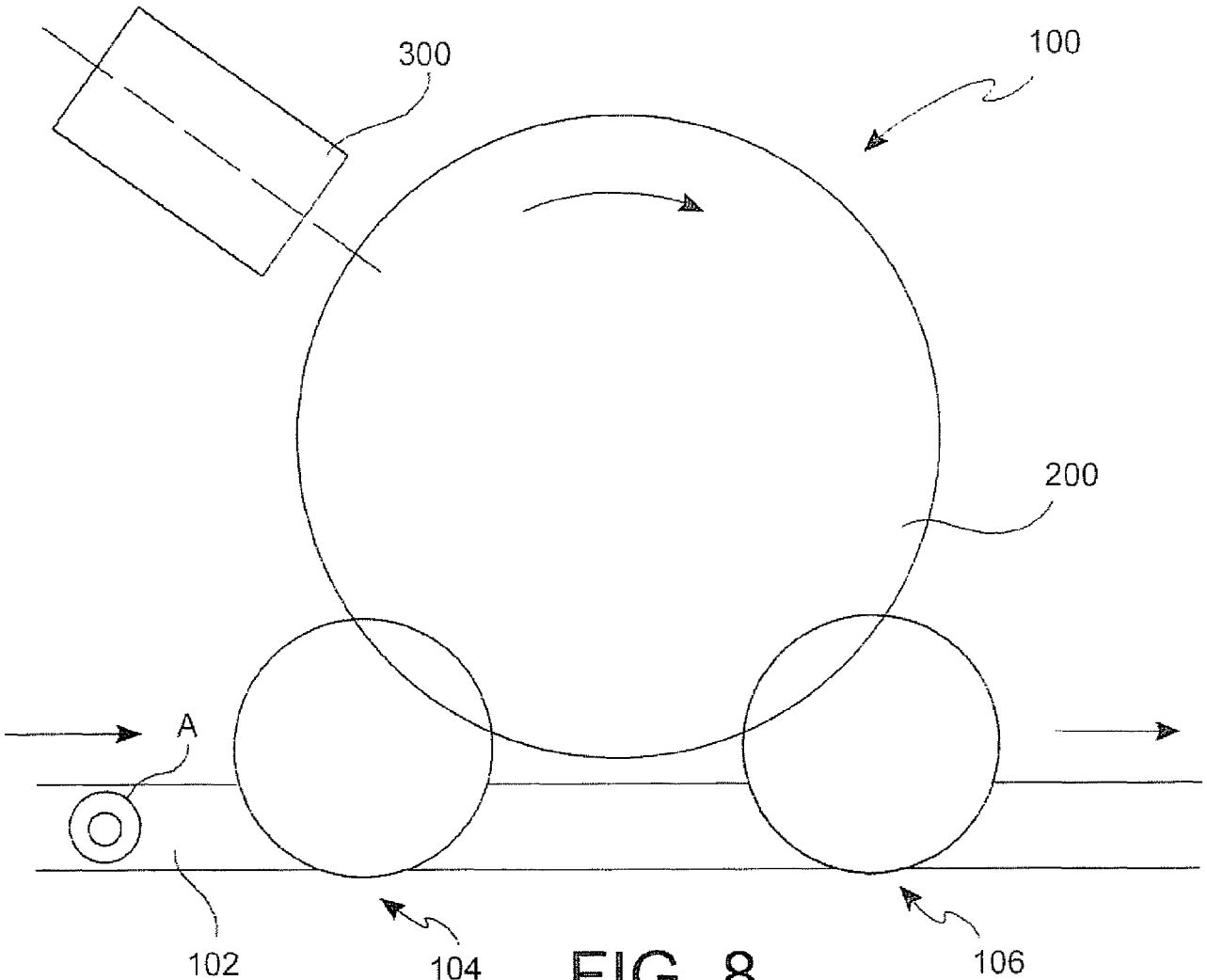
FIG. 8 shows schematically the main components of one possible embodiment example of a label arrangement.

The illustrated embodiment of FIG. 8 shows a possible embodiment of a labeling arrangement 100 suitable for being used for example in a filling plant for bottles A or other containers. The labeling arrangement 100 comprising a labeling machine 200 disclosed in the form of a rotating labeling machine.

The labeling arrangement 100 has at least one modular labeling station 300, device, or module, for applying labels to bottles or containers.

The labeling machine 200 provides equipments for handling the containers, for example bottles that are supplied preferably standing upright, i.e. with their bottle axis oriented or substantially oriented in the vertical direction, via a conveyor 102 to a container inlet 104. After labeling, the bottles are transferred to a container outlet 106 and are supplied standing upright to another use.

Figure 1:
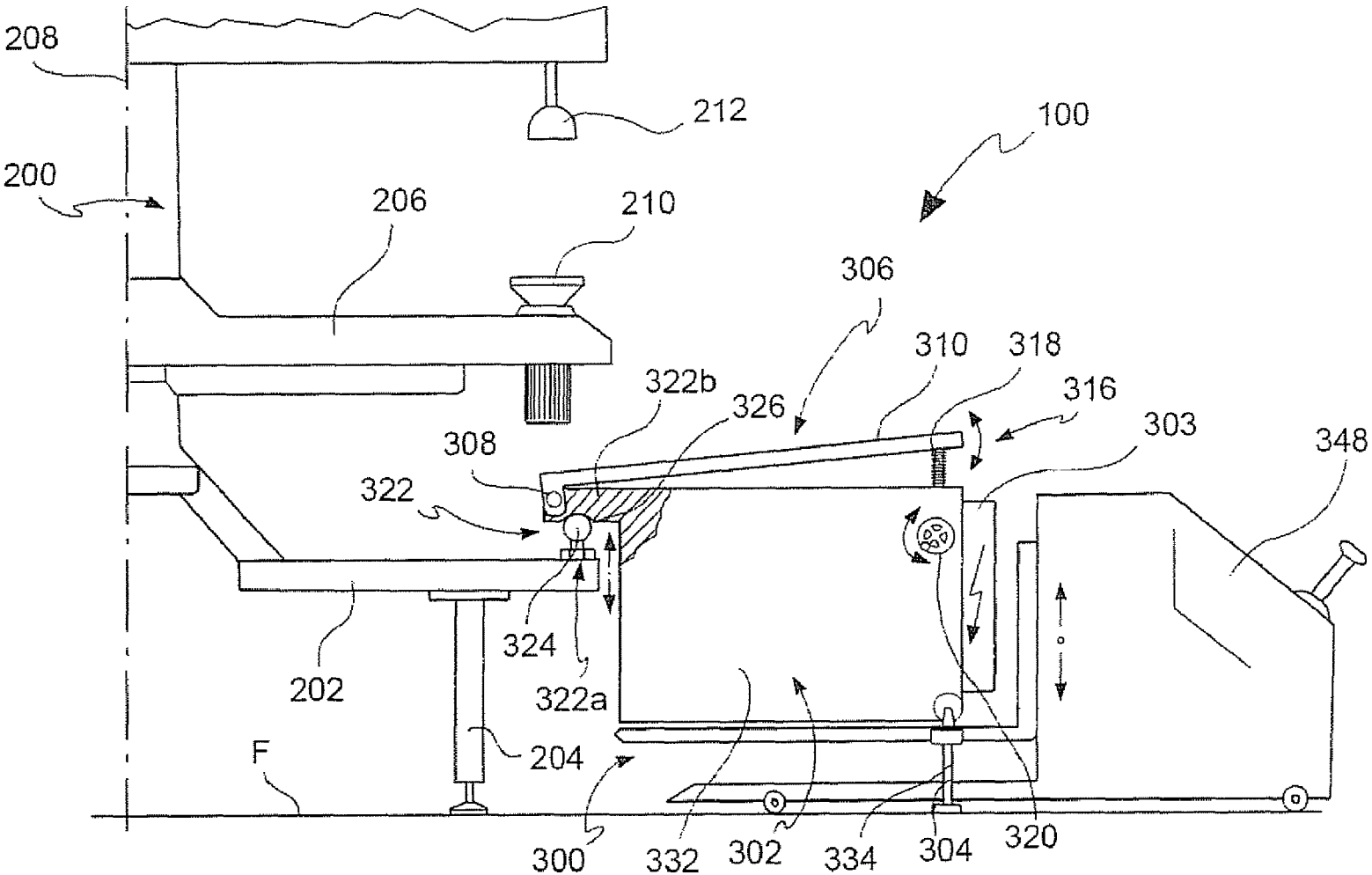
FIG. 1 shows schematically a partial side view of one embodiment of a modular labeling station.

According to FIG. 1, the rotary labeling machine 200 comprises a table 202 mounted on a floor F by means of feet 204. The table 202 supports a carousel 206 rotating about a vertical axis 208. On the circumference of the carousel 206 are formed a plurality of standing surfaces 210 known to one skilled in the art to which the bottles are individually transferred at the container inlet 104 and on which the bottles during the labeling process are held using a stamp 212 provided over each standing surface by clamping between this stamp and the standing surface.

In at least one possible embodiment of the present application, provided on the periphery of the carousel 206 are a plurality of modular labeling stations 300, only one of which is shown in the figures for the sake of simplicity. The modular labeling station 300 has all the functional elements necessary for affixing labels to the bottles or containers. Each modular labeling station is detachable and hence interchangeable so that the labeling machine can be converted with no problem and without expending a great deal of time from one type or size of bottle or container to another type or size of bottle or container and/or from one type of label or equipment to another type of label or equipment, etc., merely by exchanging the modular labeling station 300.

Each modular labeling station 300 comprises a base 302 suitable to lay on the floor at a side distal from the labeling machine and to lay substantially on the labeling machine at a side proximal to the labeling machine itself. Advantageously the base 302 is provided with at least one foot 304 at a side of the base which is distal from the labeling machine 200. In the example shown in FIGS. 1 and 2, the base comprises two feet 304 which are preferably fixed to a portion of the base, i.e. they are not height-adjustable. Preferably the other side of the base, i.e. the side which is proximal to the labeling machine does not comprise feet.

According to one possible embodiment, the base 302 forms or comprises a box 303 for mechanical, electrical and electronic components.

Each labeling station 300 further comprises a labeling unit 306 (not completely shown) mounted on the base 302 in an adjustable manner. In particular the labeling unit 306 is mounted on the base 302 so that it can be rotate about an adjustment axis 308 substantially horizontal and tangential with respect to the labeling machine 200. The adjustment axis 308 is preferably disposed at a side of the labeling station 300 which is proximal to the labeling machine.

Advantageously the base 302 lays on the labeling machine at a portion that is structurally independent from the labeling unit 306 and in particular from the adjustment axis 308.

Figure 2:
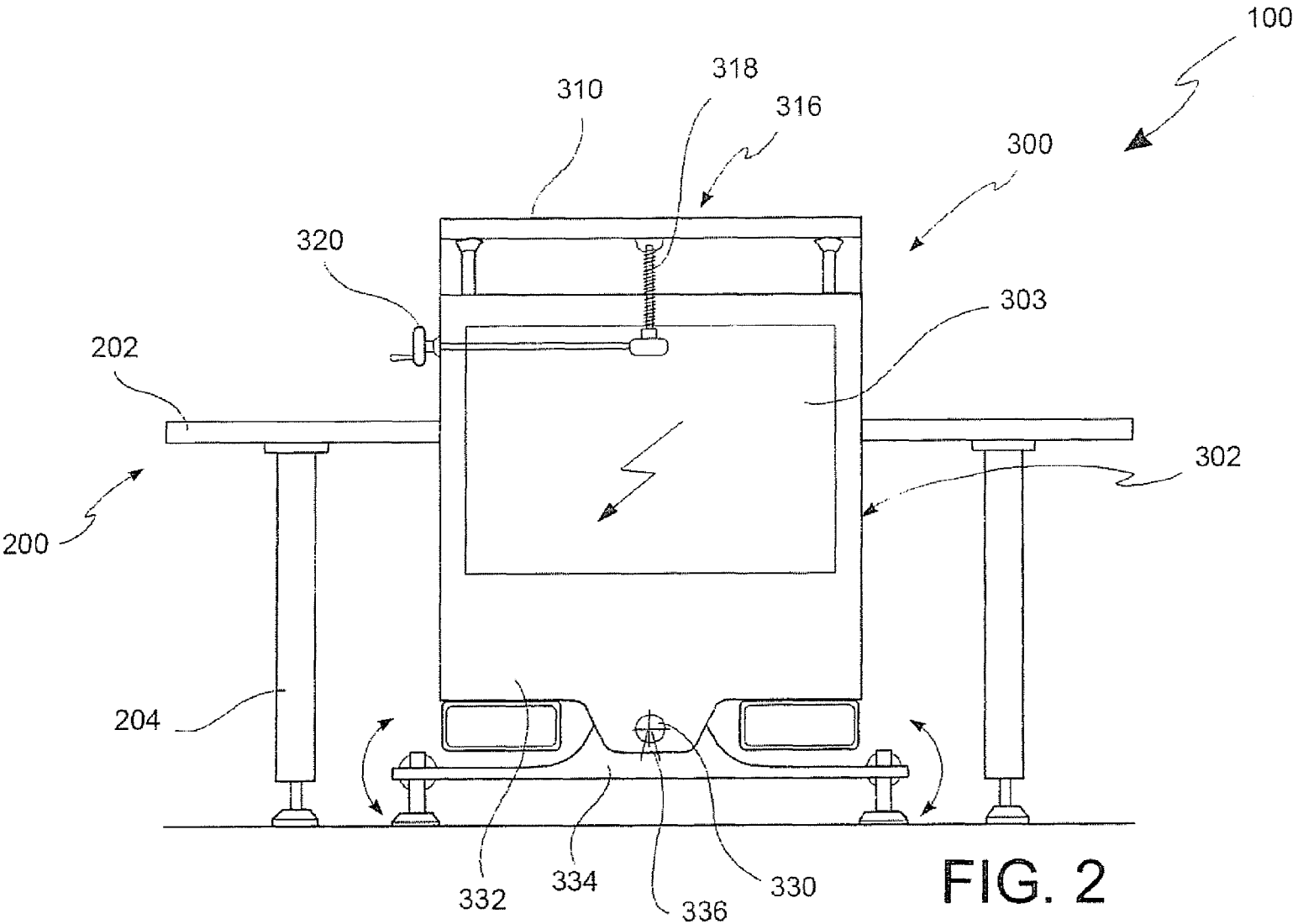
FIG. 2 shows schematically a rear view of FIG. 1 according to a possible embodiment, when the modular labeling station has been mounted on the label machine.
Figures 3, 4, 5:
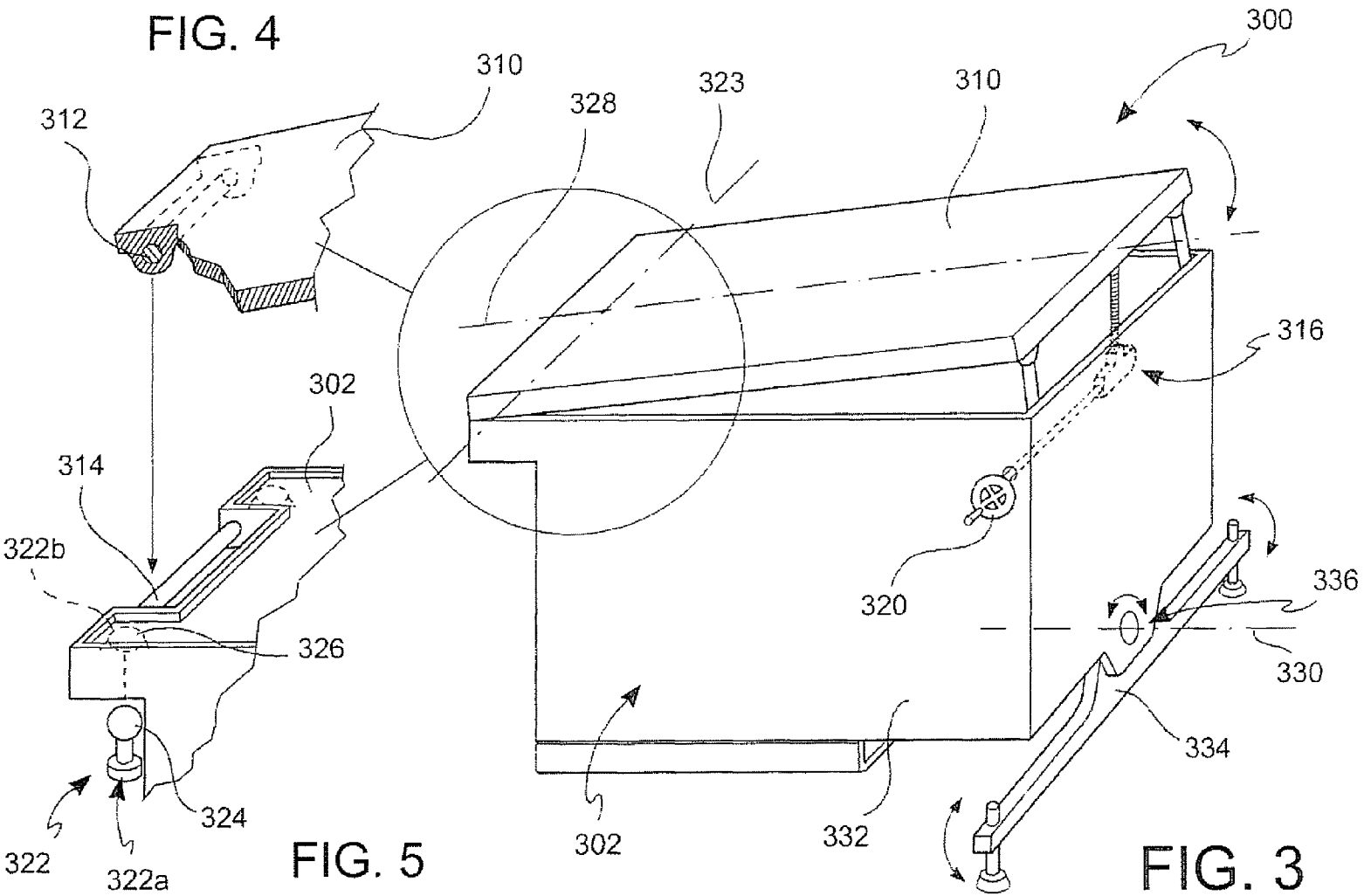
FIG. 3 shows schematically a partial perspective view of the modular labeling station of FIG. 2.
FIG. 4 shows schematically an enlarged detail of FIG. 3.
FIG. 5 shows schematically an enlarged detail of FIG. 3.

According to one possible embodiment, for example shown in FIGS. 1 and 2, the labeling unit 306 comprises a support plate 310 mounted on the base 302 in a balancing way. Preferably the support plate 310 is mounted on the base 302 by means of a hinged connection preferably disposed at a side of the labeling station 300 which is proximal to the labeling machine. According to one example shown in FIGS. 4 and 5, the support plate 310 comprises a cylindrical seat 312 for receiving a pin 314 of the base 302 defining the above mentioned adjustment axis 308.

According to one possible embodiment, the labeling station 200 comprises lifting means 316 functionally interposed between the base 302 and the labeling unit 306, preferably the support plate 310 in order to adjust the position of the labeling unit relative to the base about the adjustment axis 308. According to one possible embodiment, the lifting means 316 comprise a threaded pin 318 rotated for example by means of a hand-wheel 320. Alternatively, the lifting means comprise a motor with a control unit configured to perform the alignment (adjustment of the position of the labeling unit relative to the base) in function of preset or preselectable parameters which can be stored in a memory support of the labeling station or of the machine. Said control unit may be further configured to recognize the labeling station and to automatically perform the alignment.

For the aligned arrangement of the base 302 with respect to the labeling machine 200 and the container standing surfaces there, the base 302 is mounted preferably on the table 202 of the labeling machine 200 by means of centering means 322.

Advantageously the centering means 322 are structurally independent from the labeling unit 306 and in particular from the adjustment axis 308.

According to one embodiment, the centering means 322 are disposed distal from the labeling machine with respect to the adjustment axis 308, i.e. the adjustment axis 308 is radially closer to the vertical axis 208 of the labeling machine 200.

According to one embodiment, the centering means 322 comprise at least a machine side portion 322*a* and at least a station side portion 322*b* disposed at the base 302. Advantageously the centering means 322 comprise two machine side portions 322*a* and two station side portions 322*b* that are offset relative to one another in the circumferential direction of the labeling machine table 200.

According to one embodiment the centering means 322 form a ball coupling between the base 302 and the labeling machine 200. In this case one of the portions of the centering means 322 comprises at least a ball 324 and the other portion of the centering means 322 comprises at least a seat 326 for the ball 324. In the embodiment shown in FIG. 1, the machine side portion 322*a* of the centering means 322 comprises at least a ball 324 and the station side portion 322*b* (which may be formed integrally with the base 302 or separately fabricated and then connected thereto) comprises at least a seat 326 for the ball 324. Preferably the centering means 322 comprises two ball 324 disposed at opposite sides with respect to a medial radial direction 328, i.e. offset relative to one another in the circumferential direction of the labeling machine 200.

According to one possible embodiment, the centering means 322 may be suitable for allowing the base to adjust its position about a horizontal axis 330 which may be advantageously disposed radially with respect to the vertical axis 208 of the labeling machine 200. Advantageously the base 302 may comprise a central block 332 mounted on a foot block 334 by means of connecting means 336 allowing relative rotation of the central block about the horizontal axis 330, at least during the mounting step of the labeling station on the labeling machine. According to one possible embodiment, the connecting means 336 comprise a hinged connection allowing relative rotation of the central block about the horizontal axis 330, at least during the mounting step of the labeling station on the labeling machine. Advantageously the connecting means 336 may be suitable for being fixed during normal working of the labeling arrangement. In accordance with an embodiment, damping means may be arranged between the foot block and the base 302, e.g. translational damping means or rotational dampers suitable to damp the relative movement between the foot block and the base 302.

According to one possible embodiment, the centering means 322 may be suitable for allowing the base to adjust its position about a horizontal axis 323 which may be advantageously disposed at a periphery of the labeling machine 200, for example along a tangential direction. In this case the base 302 may comprise height adjustable feet disposed at a distal portion of the base with respect to the labeling machine.

Figure 6:
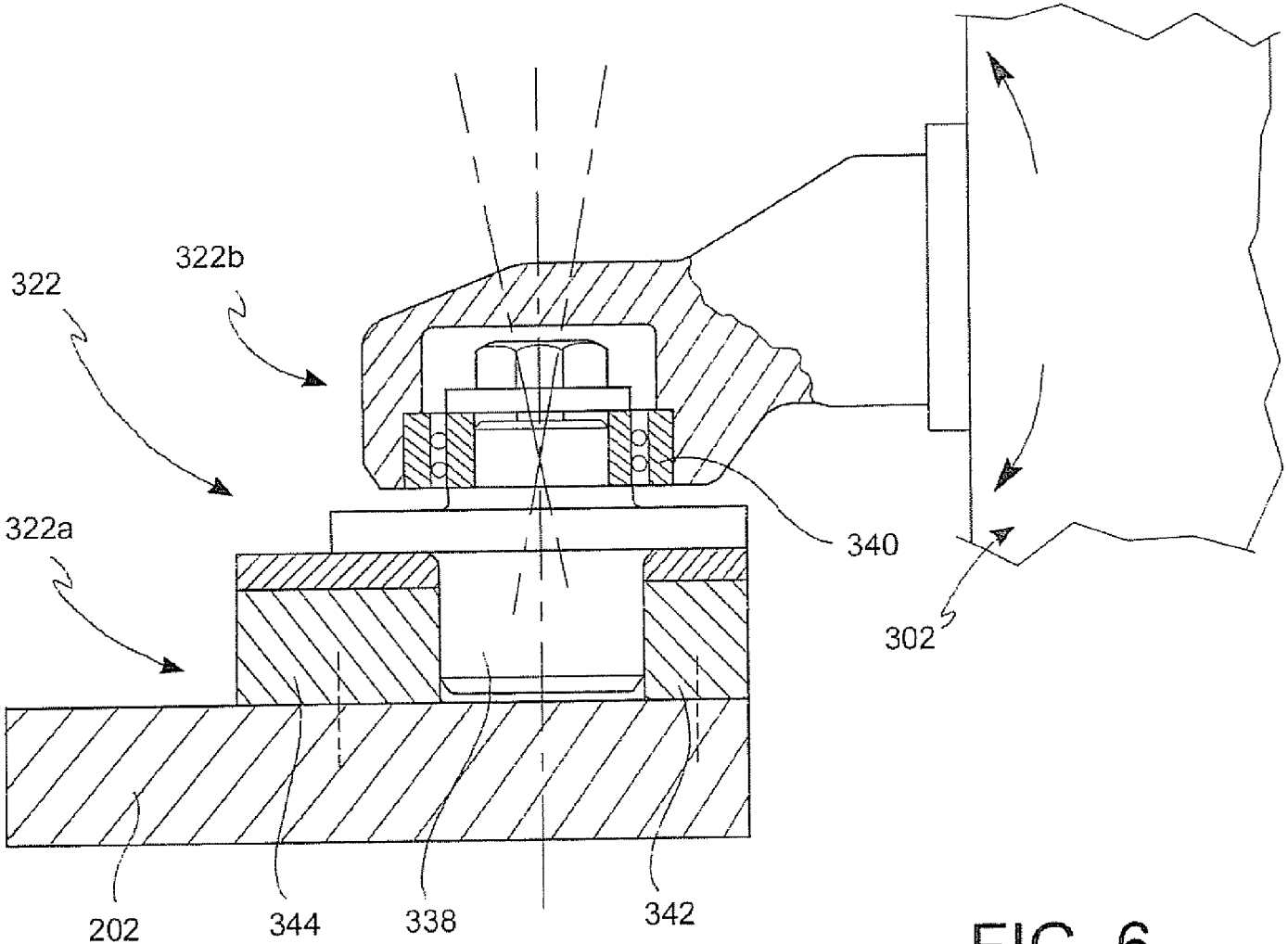
FIG. 6 shows schematically an enlarged side view of a detail of a possible embodiment of a modular labeling station.
Figure 7:
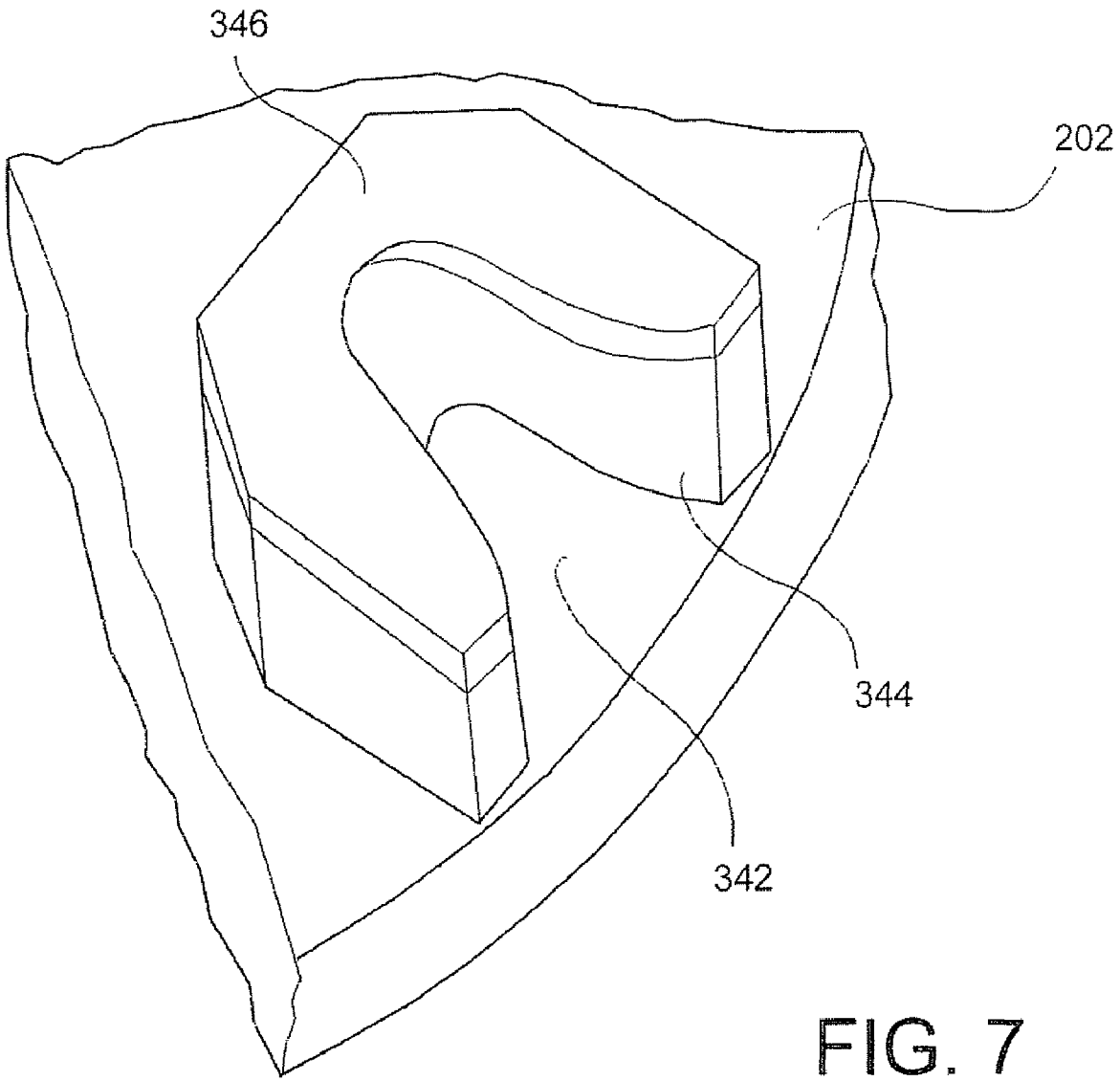
FIG. 7 shows schematically an enlarged perspective view of a detail of a possible embodiment of a modular labeling station.

According to a possible embodiment, for example shown in FIGS. 6 and 7, the centering means 322 may comprise at least a pin 338 mounted on one of the side portion 322*a* or 322*b* of the centering means 322. Advantageously the centering means 322 comprise two pins 338 disposed at opposite sides with respect to the medial radial direction 328. According to one possible embodiment, the pin 338 is adjustable mounted on the respective side portion of the centering means, for example by means of a bearing 340, preferably a ball bearing.

Each pin 338 is suitable to be housed in a corresponding seat 342 of the other side portion of the centering means 322. The seat 342 may advantageously be opened at an exterior side in order to receive the pin moved along a radial direction with respect to the vertical axis 208. According to one possible embodiment, each seat 342 may be formed by a pocket 344, for example made of steel. Advantageously the pocket may comprise an upper layer 346 for example made of anti-friction material such as PTFE, in order to simplify the docking and to eliminate the risk of wear.

According to one embodiment for example shown in FIGS. 6 and 7, each seat 342 forms the machine side portion of the centering means and is fixed to the labeling machine 200, in particular to the table 202. Each pin 338 forms the station side portion of the centering means and is mounted on the base 302.

According to one possible embodiment, each labeling unit 306 may have a discrete drive for its functional units. This drive is for instance electrically synchronized with the drive of the carousel 206.

According to different embodiments, not shown, the centering means may be formed by any convex surfaces, or by a bolt or rod.

According to the embodiment shown in FIG. 1, the positioning step of a modular labeling station with respect to the labeling machine is hereinafter disclosed.

The base 302 with the labeling unit 306 is store in a store not shown. When a predetermined labeling unit 306 is needed, it is lifted and carried from the store by means of a fork lift 348. Then the labeling station is positioned above the corresponding machine side portion of the centering means and lowered by means of the fork lift. When the machine and station side portion of the centering means are coupled, the central block 332 of the base 302 is in a relative position with respect to the feet block 334 depending on the form of the floor. The connecting means 336 allows relative rotation of the central and foot block about the horizontal axis 330 during the mounting step of the labeling station on the labeling machine. Then the connecting means 336 may be locked in order to avoid relative rotations between the central and the foot block during normal working of the labeling arrangement. Alternatively, such relative movement can be damped by means of the above described damping means.

Finally the position of the labeling unit 306 is adjusted by means of the lifting means 316 which are suitable to raise or to lower the distal side of the support plate 310 in order to adjust the position of the labeling unit relative to the base about the adjustment axis 308. In accordance with an embodiment, the support plate and its tilting or rotatable support are configured to rotatably adjust the position of the labeling unit, e.g. to label non-cylindrical containers.

At least one possible embodiment of the present application is described herein. It is understood that further changes and modifications are possible without departing from the inventive thought underlying at least one possible embodiment of the present application.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A modular labeling station detachably connectable to a labeling machine and operable to affix labels to containers held by a carousel of said labeling machine, said modular labeling station having a proximal side at which the labeling station is connectable to the labeling machine and a distal side opposite the proximal side and facing away from the labeling machine when the labeling station is connected to the labeling machine, the labeling station comprising:

a base intended to stand on a floor on the distal side and to be coupled to the labeling machine on the proximal side of the labeling machine, a labeling unit adjustably mounted on the base by means of a support plate, and centering means for mounting the base on said labeling machine, said centering means comprising a station side portion adapted to couple to a corresponding machine side portion of the labeling machine, wherein the base comprises:

a foot block having one or more feet for supporting the labeling station on the floor, said one or more feet being provided only on the distal side of the labeling station, a central block rotatably connected to the foot block by a first hinge which allows relative rotation of the central block with respect to the foot block about a horizontal axis, wherein said station side portion of the centering means is provided at the central block on the proximal side of the labeling station, the support plate of the labeling unit is rotatably connected to the central block by a second hinge arranged at the proximal side of the labeling station and allowing relative rotation of the support plate with respect to the central block about an adjustment axis, said adjustment axis of said second hinge is different from said horizontal axis of said first hinge, said second hinge is arranged at a distance from said station side portion of the centering means, and further comprising lifting means connected between the central block and the support plate and operable to adjust the position of the support plate relative to the central block by lowering or raising a distal end of the support plate with respect to the central block thereby rotating the support plate about the adjustment axis.

2. A labeling arrangement comprising:

a rotary labeling machine having a table supporting a carousel adapted to hold containers to be labeled and rotatable about a vertical axis, at least one modular labeling station detachably connected to a periphery of the rotary labeling machine and operable to affix labels to containers held by a carousel, the labeling station having a proximal side at which the labeling station is connected to the labeling machine and a distal side opposite the proximal side and facing away from the labeling machine, the labeling station comprising:

a base intended to stand on a floor on the distal side and coupled to the labeling machine on the proximal side of the labeling station, a labeling unit adjustably mounted on the base by means of a support plate, centering means for mounting the base on said labeling machine, said centering means comprising a station side portion detachably coupled to a corresponding machine side portion of the labeling machine, wherein the base comprises:

a foot block having one or more feet for supporting the labeling station on the floor, said one or more feet being provided only on the distal side of the labeling station, a central block rotatably connected to the foot block by a first hinge which allows relative rotation of the central block with respect to the foot block about a horizontal axis, wherein said station side portion of the centering means is provided at the central block on the proximal side of the labeling station, the support plate of the labeling unit is rotatably connected to the central block by a second hinge arranged at the proximal side of the labeling station and allowing relative rotation of the support plate with respect to the central block about an adjustment axis, said adjustment axis of said second hinge is substantially horizontal and tangential to the periphery of the labeling machine and said horizontal axis of said first hinge is radial to said vertical axis of said labeling machine, said second hinge is arranged at a distance from said station side portion of the centering means, and lifting means are connected between the central block and the support plate and operable to adjust the position of the support plate relative to the central block by lowering or raising a distal end of the support plate with respect to the central block, thereby rotating the support plate about the adjustment axis.

3. The labeling arrangement according to claim 2, wherein the adjustment axis is disposed at a side of the labeling station which is proximal to the labeling machine.

4. The labeling arrangement according to claim 2, wherein the base comprises at least one foot at a side of the base which is distal from the labeling machine, the at least one foot being not height-adjustable.

5. A labeling arrangement according to claim 2, wherein the centering means are structurally independent from the labeling unit and from an adjustment axis of the labeling unit on the base.

6. The labeling arrangement according to claim 5, wherein the centering means are disposed distal from the labeling machine with respect to the adjustment axis.

7. The labeling arrangement according to claim 2, wherein the connecting means are suitable for being fixed during normal working of the labeling arrangement.

8. The labeling arrangement according to claim 2, wherein said at least one floor-resting foot comprises at least two non-height-adjustable feet.

9. A labeling arrangement comprising:

a rotary labeling machine having a table supporting a carousel adapted to hold containers to be labeled and rotatable about a vertical axis, at least one modular labeling station detachably connected to a periphery of the rotary labeling machine and operable to affix labels to containers held by a carousel, the labeling station having a proximal side at which the labeling station is connected to the labeling machine and a distal side opposite the proximal side and facing away from the labeling machine, the labeling station comprising:

a base intended to stand on a floor on the distal side and coupled to the labeling machine on the proximal side of the labeling station, a labeling unit adjustably mounted on the base by means of a support plate, centering means for mounting the base on said labeling machine, said centering means comprising a station side portion detachably coupled to a corresponding machine side portion of the labeling machine, wherein the base comprises:

a foot block having one or more feet for supporting the labeling station on the floor, said one or more feet being provided only on the distal side of the labeling station, a central block rotatably connected to the foot block by a first hinge which allows relative rotation of the central block with respect to the foot block about a horizontal axis, wherein said station side portion of the centering means is provided at the central block on the proximal side of the labeling station, the support plate of the labeling unit is rotatably connected to the central block by a second hinge arranged at the proximal side of the labeling station and allowing relative rotation of the support plate with respect to the central block about an adjustment axis, said adjustment axis of said second hinge is substantially horizontal and tangential to the periphery of the labeling machine and said horizontal axis of said first hinge is radial to said vertical axis of said labeling machine, said second hinge is arranged at a distance from said station side portion of the centering means, and lifting means are connected between the central block and the support plate and operable to adjust the position of the support plate relative to the central block by lowering or raising a distal end of the support plate with respect to the central block, thereby rotating the support plate about the adjustment axis, wherein the centering means comprise at least a pin mounted on one of the side portion of the centering means.

10. The labeling arrangement according to claim 9, wherein the pin is adjustably mounted on the respective side portion of the centering means.

11. The labeling arrangement according to claim 10, wherein the pin is mounted in the respective side portion by a bearing.

12. The labeling arrangement according to claim 9, wherein the pin is suitable to be housed in a corresponding seat of the other side portion of the centering means, the seat being opened at an exterior side in order to receive the pin moved along a radial direction with respect to a vertical axis of the labeling machine.

13. The labeling arrangement according to claim 12, wherein the seat is formed by a pocket comprising an upper layer for example made of anti-friction material.

14. The labeling arrangement according to claim 12, wherein the anti-friction material is PTFE.

* * * * *